United States Patent [19]

Nitta

[11] Patent Number: 4,904,180

[45] Date of Patent: Feb. 27, 1990

[54] GASLIGHTER EQUIPPED WITH A LOCKING MEANS TO PREVENT UNDESIRED IGNITION

[75] Inventor: Tomio Nitta, Yokohama, Japan

[73] Assignee: Tokai Corporation, Yokohama, Japan

[21] Appl. No.: 362,536

[22] Filed: Jun. 6, 1989

[30] Foreign Application Priority Data

Jun. 7, 1988 [JP] Japan ..... 63-74779[U]

[51] Int. Cl.[4] ..... F23D 11/36

[52] U.S. Cl. ..... 431/153; 431/277; 222/153; 222/402.11; 251/95; 251/106

[58] Field of Search ..... 431/153, 255, 277, 267, 431/131, 253; 222/153, 402.11, 384; 251/95, 102, 105, 106, 319

[56] References Cited

U.S. PATENT DOCUMENTS

| | | | |
|---|---|---|---|
| 3,898,031 | 8/1975 | Rusakowicz | 431/153 X |
| 4,784,602 | 11/1988 | Nitta | 222/402.11 X |
| 4,786,248 | 11/1988 | Nitta | 222/402.11 X |
| 4,832,596 | 5/1989 | Morris, Sr. | 431/153 |

*Primary Examiner*—Randall L. Green

*Attorney, Agent, or Firm*—Armstrong, Nikaido, Marmelstein, Kubovcik & Murray

[57] ABSTRACT

Disclosed is a piezoelectric gas lighter equipped with a safety lock means to prevent undesired ignition. It uses a spring-biased stopper to keep the gaslighter locked and cause an automatic return to locked position after use, thereby guaranteeing prevention of any accident which might otherwise be caused if the gaslighter is inadvertently unlocked or if the gaslighter is by chance unlocked while it is being carried.

2 Claims, 3 Drawing Sheets

GASLIGHTER EQUIPPED WITH A LOCKING MEANS TO PREVENT UNDESIRED IGNITION

BACKGROUND OF THE INVENTION

1. Field of the Invention

The present invention relates to a piezoelectric type of gaslighter, particularly such a gaslighter equipped with a locking means to prevent undesired ignition.

2. Related Arts

As is well known, a piezoelectric type of gaslighter has an ignition unit and a thumb-operated lever operatively connected both to said ignition unit and to a gas ejection nozzle. The ignition unit comprises a piezo element and a striker, and the gas ejection nozzle communicates with the gas well in the gaslighter housing. The thumb-operated lever is slidably mounted in the gaslighter housing. When the thumb-operated lever is pushed down to a lower position by the thumb, a gas ejection nozzle is made to open, and at the same time, the striker applies a striking force to the piezoelectric element to generate a voltage high enough to ignite the gas ejection nozzle.

The descent of the thumb pusher automatically causes ignition of the gas ejection nozzle. Therefore, it is feared that there could be accidental flame-striking while children are playing with gaslighters, in which children may suffer a burn or a fire may start.

In an attempt to avoid such an accident, a piezoelectric gaslighter equipped with a locking means to prevent undesired flame striking was proposed, for instance in Japanese Utility Model No. 62-180251 (A) or No. 62-180253 (A). This type of piezoelectric gaslighter comprises a gaslighter housing having a windshield and a flame-striking thumb-pusher adjacent to the windshield; and a stopper slidably fitted on the flame-striking thumb-pusher. The forward end of the slidable stopper stays above the windshield mount, causing the forward end of the stopper to be caught by the windshield mount when one attempts to lower the flame-striking thumb-pusher without pulling back the stopper, thereby preventing the descent of the thumb-pusher for flame-striking. Once the gaslighter has been unlocked by withdrawing the stopper, the gaslighter will remain unlocked unless the stopper is pushed forward to the locking position in which the forward end of the stopper stays above the windshield mount. Therefore, the gaslighter often remains unlocked. In addition, the gaslighter can accidentally become unlocked while being carried.

SUMMARY OF THE INVENTION

In view of the above, one object of the present invention is to provide a piezoelectric gaslighter which permits automatic return of the stopper to the locking position after use.

To attain this object according to the present invention a gaslighter equipped with a locking means to prevent undesired ignition comprises: a gaslighter housing having an intervening mount on its top, a windshield fixed to said intervening mount and a flame-striking thumb-pusher adjacent to said windshield; and a stopper slidably fitted on said flame-striking thumb-pusher, said stopper being spring-biased and urged towards said windshield by rubber, coil spring, leaf spring or any other resilient means until it has reached the locked position in which the forward end of said stopper stays above said intervening mount, thus causing the forward end of said stopper to be caught by said intervening mount when one attempts to lower said flame-striking thumb-pusher without pulling back said stopper, thereby preventing the lowering of said flame-striking thumb-pusher.

According to a preferred embodiment of the present invention, said stopper has a generally U-shape, and said flame-striking thumb-pusher has a leaf spring embedded therein, thereby keeping said stopper urged towards said windshield with the forward end of said stopper directly above said intervening mount. This initial position prevents lowering of the thumb-pusher for ignition of the gas ejection nozzle. When in use, the stopper is drawn backwards until the forward end of the stopper is no longer above the windshield mount, allowing the thumb pusher to be pushed down, thereby causing the striker to strike the piezoelectric element. Then, the resulting electric spark ignites the gas ejection nozzle.

When the thumb-pusher is released, it resumes its initial position, and the spring-biased stopper is automatically shifted toward the windshield to the locked position in which the forward end of the slidable stopper is directly above the windshield mount, thus preventing the lowering of the thumb-pusher for ignition of the gas ejection nozzle.

Other objects and advantages of the present invention will be understood from the following description of a piezoelectric type of gaslighter according to a preferred embodiment which is shown in the accompanying drawings:

PREFERRED EMBODIMENT OF THE INVENTION

Figure 1:
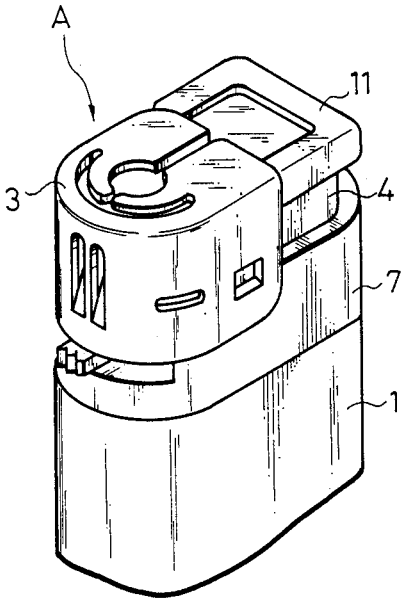
FIG. 1 is a perspective view of the upper part of the piezoelectric type of gaslighter.

Referring to these drawings, a piezoelectric gaslighter according to the present invention is indicated at A. It is equipped with a locking means to prevent undesired ignition. As shown, it comprises a gaslighter housing 1 having an intervening mount 7 on its top, a windshield 3 fixed to the intervening mount 7 and encircling a gas ejection nozzle 2 and a flame-striking thumb-pusher 4 adjacent to the windshield. The gaslighter housing 1 includes a gas well 5, and has an upper closure 6 to close the opening of the gas well 5. The intervening mount 7 is fitted on the upper closure 6, and a flame-striking piezoelectric unit 8 is fitted in the intervening mount 7.

Figure 6:
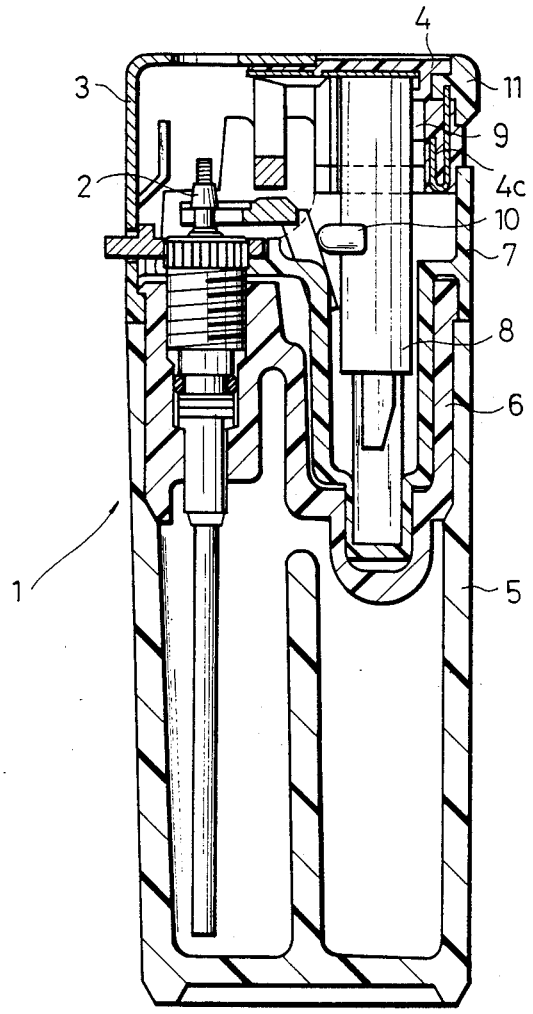
FIG. 6 is a longitudinal section of the gaslighter.

As seen from FIG. 6, the upper part of the flame-striking piezoelectric unit 8 appears on the intervening mount 7, and the thumb-pusher 4 is fixed to the upper part of the flame-striking piezoelectric unit 8. The thumb-pusher 4 is vertically movable, and is upwardly spring-biased. The flame-striking piezoelectric unit 8 is composed of a striker and a piezoelectric element (not shown). When the thumb pusher 4 is depressed by the thumb, the striker will be driven to strike the piezoelectric element to generate a high voltage between terminals 9 and 10. The flame-striking piezoelectric unit 8 is operatively connected to the gas ejection nozzle 2 in such a way that the gas ejection nozzle is permitted to eject the flammable gas synchronously with the striking of the piezoelectric element.

Figure 2:
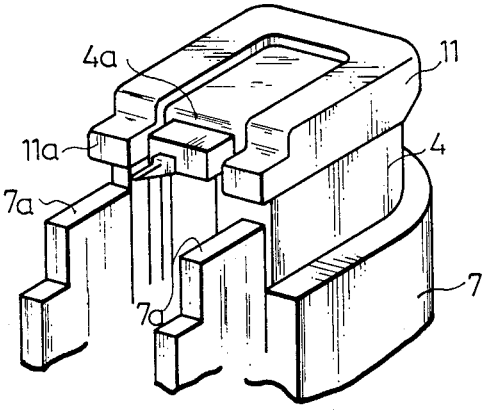
FIG. 2 is a similar perspective view, but showing the gaslighter with its windshield removed.
Figure 3:
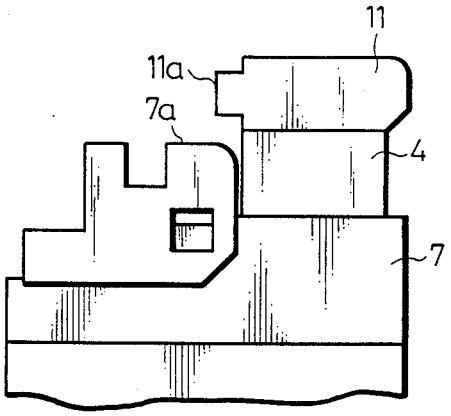
FIG. 3 is a schematic view showing the gaslighter in its locked condition.
Figure 4:
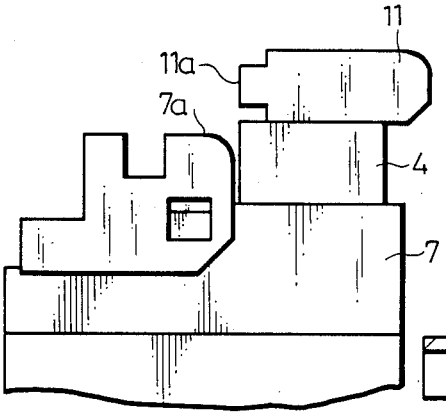
FIG. 4 is a similar schematic view showing the gaslighter in its unlocked condition.

As best shown in FIG. 2, a generally U-shaped stopper 11 is slidably fitted to the top of the thumb-pusher 4 by fitting its inside ridges (not shown) in the corresponding notches (not shown) made on the three sides of the thumb-pusher 4 excluding the side 4*a* facing the windshield 3. Thus, the stopper is slidably fitted on the flame-striking thumb-pusher.

Figure 5:
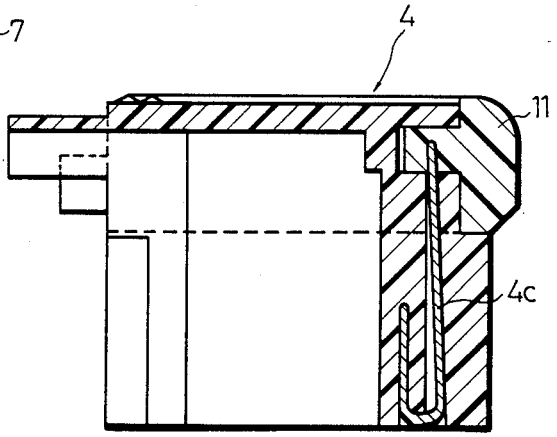
FIG. 5 is a longitudinal section of the upper part of the gaslighter, showing the manner in which a stopper is slidably fitted on the top of the thumb-operated lever.

As shown in FIG. 5, a hook-shaped leaf spring 4*c* is partly embedded in the thumb-pusher 4, and the end of the leaf spring 4*c* is fixed to the stopper 11. Thus, the stopper 11 is spring-biased and urged toward the windshield 3 until it has reached the locked position in which the forward end 11*a* of the stopper 11 is directly above the part 7*a* of the intervening mount 7. With this arrangement the forward end 11*a* of the stopper 11 will be caught by the intervening mount part 7*a* when one tries to lower the flame-striking thumb-pusher 4 without pulling back the stopper, thereby preventing the descent of the flame-striking thumb-pusher. As a substitute for the leaf spring, rubber, coil spring, or any other resilient means may be used.

When in use, the stopper is drawn backward until the forward end 4*a* of the stopper 11 is no longer above the windshield mount 7*a*, allowing the thumb-pusher 4 to be pushed down, thereby causing the striker to strike the piezoelectric element. Then, the resulting electric spark ignites the gas ejection nozzle 2.

When the thumb-pusher 4 is released, it resumes its initial position, and the spring-biased stopper 11 automatically springs back toward the windshield 3 to the locked position in which the forward end 11*a* of the slidable stopper 4 is directly above the windshield mount, thus preventing the lowering of the thumb-pusher for ignition of the gas ejection nozzle.

As may be understood from the above, a piezoelectric type of gaslighter uses a spring-biased stopper to keep the gaslighter locked and cause an automatic return to the locked position after use, thereby guaranteeing prevention of any accident which might otherwise be caused if the gaslighter is inadvertently unlocked or if the gaslighter is by chance unlocked while it is being carried.

I claim:

1. A gaslighter equipped with a locking means to prevent undesired ignition comprising:

a gaslighter housing having an intervening mount on its top, a windshield fixed to said intervening mount and a flame-striking thumb-pusher adjacent to said windshield; and a stopper slidably fitted on said flame-striking thumb-pusher, said stopper being spring-biased and urged towards said windshield by rubber, coil spring, leaf spring or any other resilient means until it has been put in locking position in which the forward end of said stopper is directly above said intervening mount, thus causing the forward end of said stopper to be caught by said intervening mount when said flame-striking thumb-pusher is tried to be lowered without pulling back said stopper, thereby preventing the descent of said flame-striking thumb-pusher.

2. A gaslighter equipped with a locking means to prevent undesired ignition claimed in claim 1 wherein said stopper has a U-shape, and said flame-striking thumb-pusher has a leaf spring embedded therein, thereby keeping said stopper urged toward said windshield with the forward end of said stopper right above said intervening mount.

* * * * *